US007491046B2

(12) United States Patent
Baier et al.

(10) Patent No.: US 7,491,046 B2
(45) Date of Patent: Feb. 17, 2009

(54) PISTON FOR A ROTARY COMBUSTION ENGINE

(75) Inventors: Wolfgang Baier, Obbach (DE); Dankwart Eiermann, Weiβensberg (DE)

(73) Assignee: Wankel Super Tec GmbH, Cottbus (DE)

( * ) Notice: Subject to any disclaimer, the term of this patent is extended or adjusted under 35 U.S.C. 154(b) by 153 days.

(21) Appl. No.: 11/149,371

(22) Filed: Jun. 9, 2005

(65) Prior Publication Data

US 2005/0276704 A1 Dec. 15, 2005

(30) Foreign Application Priority Data

Jun. 9, 2004 (DE) ..... 10 2004 174

(51) Int. Cl.

| | |
|---|---|
| ***F01C 1/02*** | (2006.01) |
| ***F01C 19/08*** | (2006.01) |
| ***F01C 21/08*** | (2006.01) |
| ***F01C 21/00*** | (2006.01) |
| ***F02B 53/00*** | (2006.01) |
| ***F02B 53/10*** | (2006.01) |

(52) U.S. Cl. ..... 418/61.2; 418/91; 418/94; 123/200; 123/205

(58) Field of Classification Search ..... 123/200, 123/205; 418/61.2, 91, 94; *F01C 1/02, 19/08, F01C 21/08*

See application file for complete search history.

(56) References Cited

U.S. PATENT DOCUMENTS

| | | | | | |
|---|---|---|---|---|---|
| 3,176,915 | A | * | 4/1965 | Bentele et al. | 418/61.2 |
| 3,204,614 | A | * | 9/1965 | Huber | 418/91 |
| 3,400,604 | A | * | 9/1968 | Jones | 418/61.2 |
| 3,469,505 | A | * | 9/1969 | Bensinger | 418/61.2 |
| 3,799,706 | A | * | 3/1974 | Bilobran | 418/61.2 |
| 3,942,918 | A | * | 3/1976 | Hermes | 418/61.2 |
| 3,988,079 | A | * | 10/1976 | Ounsted et al. | 418/61.2 |
| 4,971,533 | A | | 11/1990 | Sutter et al. | 418/61.2 |

FOREIGN PATENT DOCUMENTS

| | | | | |
|---|---|---|---|---|
| DE | 37 28 943 | | 3/1989 | |
| JP | 54117808 | A * | 9/1979 | 418/61.2 |

* cited by examiner

*Primary Examiner*—Thai-Ba Trieu
(74) *Attorney, Agent, or Firm*—Cohen Pontani Lieberman & Pavane LLP

(57) ABSTRACT

A rotary combustion engine with at least one working unit, which has essentially a peripheral engine housing, a side housing plate on one side, a side housing plate on the power takeoff side, a triangular piston, and an eccentric shaft. The piston is configured of several parts, which are connected to each other. The connection is accomplished by electron-beam welding under vacuum, which yields excellent results as long as certain conditions are met. The one sidewall and the power takeoff sidewall of the piston are preferably welded to a piston housing, as a result of which the casting molds can be of simpler design and simpler contours can be used, which leads to welds of higher quality and to a decrease in the costs of casting.

11 Claims, 5 Drawing Sheets

PISTON FOR A ROTARY COMBUSTION ENGINE

BACKGROUND OF THE INVENTION

1. Field of the Invention

The invention pertains to a rotary piston engine.

2. Description of the Related Art

A piston for a rotary combustion engine is known from German Patent No. DE 37 28 943 C2 (U.S. Pat. Ser. No. 4,971,533). This piston rotates around an epitrochoidal orbit between the side housing plates and has sealing strips at the three tips by which it always remains in contact with the epitrochoidal orbit, where the piston is divided in a radial plane into two parts, and where means are provided so that these two parts can be pressed by their webs, which form the radially outer edges of the piston flanks, against the side housing plates, and so that an elastically deformable ring-shaped seal can be installed to seal off the gap between the two parts radially from the inside. These means consist of three guide pins, which are mounted with freedom to slide back and forth in sets of aligned bores with parallel axes passing through both parts of the piston. The pins therefore allow the force of a spring to push two parts outward against the side housing plates. The ring-shaped seal extends around the circumference and seals off the interior space of the piston against the combustion pressure.

Thus, the conventional piston is produced as a complicated one-piece casting and imposes very high standards on casting technology and, thus, leads to high cost.

A need, therefore, exists for a piston comprising several parts configured so as to alleviate the problems associated with the known prior art.

SUMMARY OF THE INVENTION

The piston of the present invention is designed to be used in rotary combustion engines which operate both on the Otto principle and on the Diesel principle, with oil cooling on the inside and air or water cooling on the outside. These rotary combustion engines can have one or possibly several working units with high working pressures.

A piston configured in accordance with a first embodiment has comprises a piston housing, a sidewall on one side, and a sidewall on the takeoff side. Here the piston housing has oil-conducting profiles, ribs, and a ring element, which are also present in the conventional piston. The conventional housing is much more difficult to manufacture, however, because the sidewalls make it necessary to use a casting mold of complicated design. That is, the internal cavities, which are interrupted by the ribs and covered on the inside by the ring element, must be produced with the help of a large number of cores, which requires in turn a corresponding number of core prints. Because of the need for extreme accuracy, it must also be expected that the rejection rate will be high. In the proposed embodiment, it is possible to cast the piston housing without the need for cores, which also means, however, that the sidewall on the one side and the sidewall on the takeoff side, which are produced separately, must then be connected to the piston housing. For this purpose, it is proposed that the piston housing be planed on both sides to produce flat surfaces on the one side and on the takeoff side. The housing wall on the one side and the housing wall on the takeoff-side are also planed, at least in the regions where they are to come into contact with the piston housing. The planed surfaces of the sidewalls preferably remain otherwise unmachined for now.

The sealing strip grooves, arc strip grooves, and sealing pin bores will be produced in them after the piston has been assembled into a unit.

To produce this unit, it is proposed that a circumferential weld be produced by electron-beam welding under vacuum, proceeding radially from the outside in the planes of the flat surfaces, while the sidewalls are resting against the piston housing. To produce a satisfactory weld, it is necessary to clamp the parts in question together with an appropriate device, so that their prepared flat surfaces rest flush against each other, because welding produces the best results when applied to solid pieces of material with the smallest possible gaps between them. It has been found that the process for producing the piston can be streamlined even more by lining up and clamping together in the axial direction a plurality of the elements to be welded together, namely, a plurality of sidewalls, of takeoff-sidewalls, and of piston housings, so that the vacuum generated for the welding process can be used for as many welding passes as possible. Each time the workpieces are changed, a new vacuum must be generated, which is expensive and time-consuming.

The thickness of the one sidewall and that of the takeoff-side sidewall in the region where they are welded should be greater than the depth of one of the arc strip grooves and/or sealing pin bores in order to prevent the combustion pressure from escaping into the interior of the piston through gaps which might be produced when the recesses for the sealing elements are machined.

In the second embodiment, a piston is proposed which has a piston housing with the full width of the piston at the external contour of the piston but which is recessed on one side in the region inside the arc strip grooves to allow the installation of a modified sidewall and also recessed on the power takeoff side inside the grooves to allow the installation of a modified takeoff-sidewall. As a result, circumferential contact surfaces are created, which are parallel to the flat surfaces and are bounded radially on the outside by the arc strip grooves.

To eliminate the steps required to produce the arc strip grooves during the final phase of piston production, the outer circumferential contours of the sidewalls are laid against the outer flanks of the arc strip grooves which, in the region of the sealing pins, extend transversely to the pin surface, the primary goal here being to minimize the size of the gaps. After the base of the groove and the inner flank of the arc strip groove have been milled into the external contour of the sidewall, there is no need for any further machining to produce the arc strip grooves.

As already mentioned, the narrower the gaps to be welded, the greater the success of welding by the electron-beam method. Just as important for the successful completion of a good weld, however, is that the runout of the seam be situated in solid material, because otherwise inclusions can occur in the molten metal of the weld, which can impair the quality and the strength of the joint. Therefore, a second contour is provided on the sidewalls next to the first contour, this second contour forming a 90° step from the circumferential contact surface. When, as in the case of the first embodiment, welding is performed in the plane of the circumferential contact surfaces proceeding inward from the outside through the solid material of the piston housing into the region of the circumferential contact surfaces, these surfaces will be welded together and the weld, after having penetrated through the step, will terminate, if produced with sufficient energy, in the solid material of the sidewalls. There is no need for a press-fit in the region of the first and second contours, because gaps which are at right angles to the weld have no significant effect on the formation of inclusions in the molten weld metal. Welding performed under vacuum is associated with very little heat distortion, for which reason it is possible to prefabricate the outer and inner flanks of the arc strip grooves. Under certain design conditions, however, it is advisable, for the sake of ensuring good welding, to use spacers in the shape of the arc strips and to insert them into the arc strip grooves to guarantee that the top of the arc strip grooves remains open.

It has also been found that welding by the electron-beam method under vacuum causes only slight distortion of the workpieces, for which reason various operations can be performed on parts which will be welded afterwards. An especially advantageous streamlining of the inventive piston is derived accordingly, in that a ring-shaped shoulder with the outside dimensions of an internal gear is formed integrally on the ring element. This ring-shaped shoulder does not present any problems with respect to casting technology in the case of the first embodiment either, because in the first embodiment the same conditions are present as those in the second embodiment. Because of the minimal extent of the distortions, the internal gear teeth can be produced in this ring-shaped shoulder either before or after the sidewalls have been welded in place, depending on how the operation fits into the overall sequence of work steps.

In a further embodiment, a piston is proposed which has a piston housing which is the same as the conventional piston with respect to its necessary width and all the recesses for the sealing elements, but which is made without a ring element. This has the result that the oil-conducting profiles and the ribs are open at their radially inner ends and that, if these elements are designed appropriately, this piston housing can be manufactured with the help of only a single core, even though the part itself is complicated. It is a disadvantage, furthermore, that the welding, which must be performed on a cylindrical plane, can be applied only to the ribs and must therefore be interrupted after each rib.

The object of the invention is therefore to create a piston for a rotary combustion engine which can be manufactured at lower cost by means of a new production method but which does not make it necessary to make any process-related changes or functional compromises affecting the interior in the region of the oil profiles and/or ribs, and which is at least equivalent in strength or even superior to the conventional piston.

Three embodiments of a multi-part piston for a rotary combustion engine are explained below on the basis of several drawings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
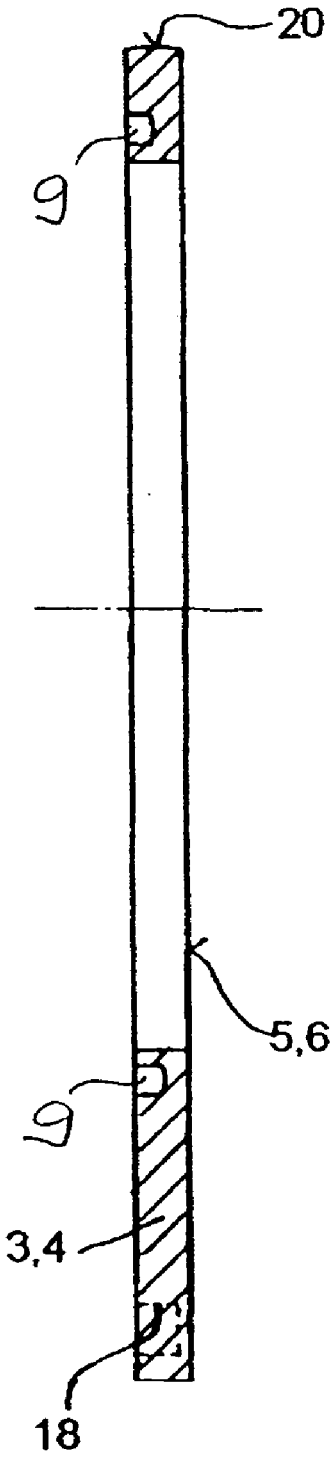
FIG. 1 shows a cross section of a sidewall, which is identical in design to a sidewall on the power takeoff side.
Figure 10:
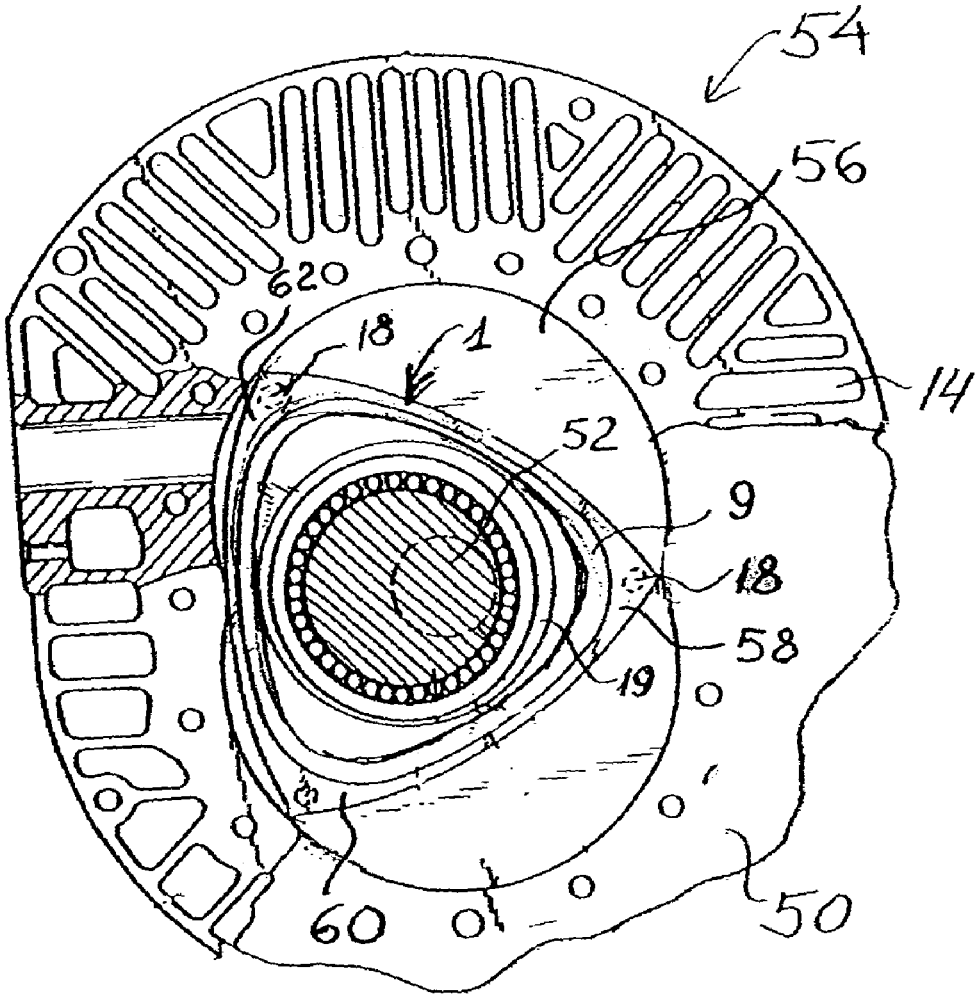
FIG. 10 is a radial section view of the rotary engine configured in accordance with the invention.

According to FIG. 1, a sidewall 3 with a flat side surface on a side 56 of engine housing 54 (FIG. 10) is shown, which is identical in design to a sidewall 4 on a power takeoff side 50 (FIG. 10) with a flat side surface. Each of the two sidewalls 3 and 4 has the outside contour 20 of a triangularly-shaped piston. The sidewalls 3 and 4 are made as semi-finished products for ultimate assembly into the piston 1, for which purpose they are welded to a piston housing 2. For this reason, they are given no further machining at this point except for the preparation of the flat surfaces and the piston contour 20. The outer flat surfaces of the finished piston 1 and the recesses for the sealing elements are produced later. The sidewalls 3 and 4 cover the interior of the piston 1 and thus let the oil-conducting profiles 7 together with the ribs 14 perform their function during the operation of the rotary combustion engine. In operation, the triangularly shaped piston 1 (FIG. 10) rotates on an eccentric shaft 52 in the engine housing 54 and, while rotating, forms three working spaces 58, 60 and 62.

Figure 2:
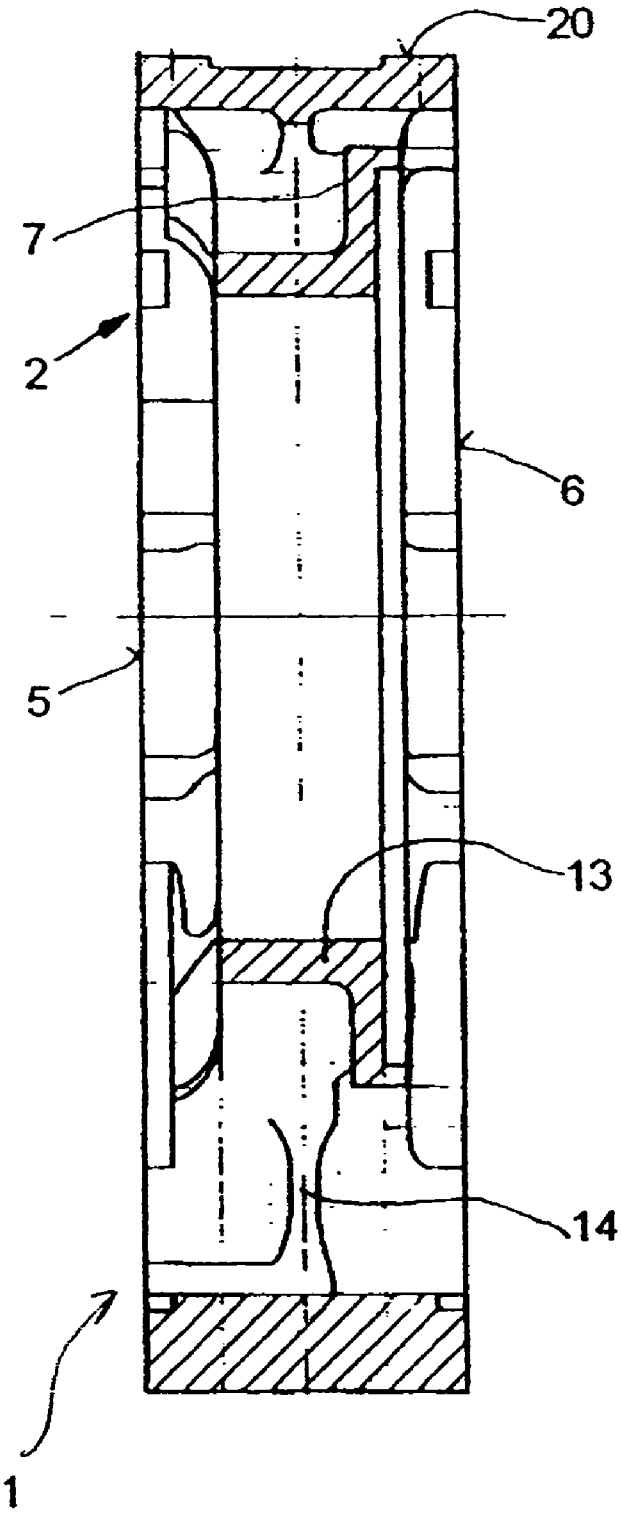
FIG. 2 shows a cross section of a piston housing with a flat surface on the one side, a flat surface on the power takeoff side, and a ring element.
Figure 5:
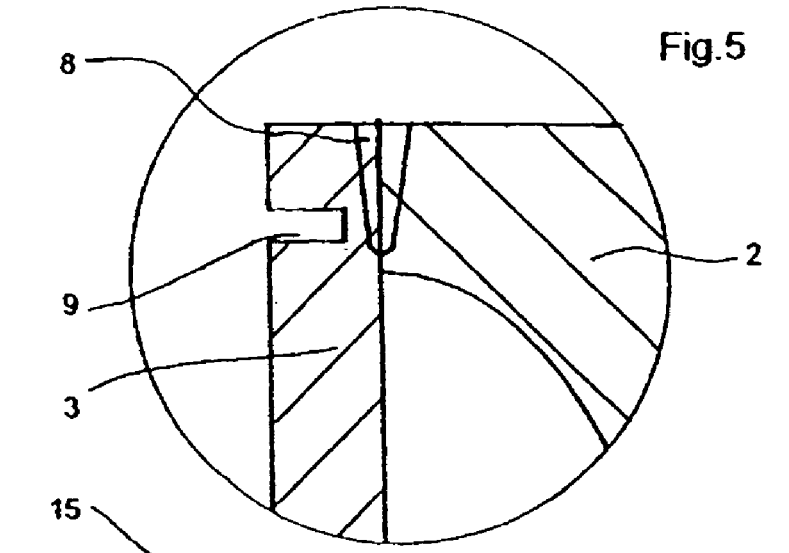
FIG. 5 shows an enlarged view of the weld which joins the sidewall element according to FIG. 1 to the piston housing element according to FIG. 2.

FIG. 2 shows a first embodiment of a piston housing 2, which has a flat surface 5 on one side and a flat surface 6 on the power takeoff side, against which the sidewalls 3, 4 are placed and clamped. The piston contour 20 extends around the outer circumference. When the sidewalls 3, 4 are clamped together with the housing, the outside contours of all three parts must be brought into alignment. A ring element 13 is coaxial to the center line of the piston 1. The ring serves as a support for the piston 1 on the eccentric shaft 52 (FIG. 10) and is made as an integral part to the piston housing 2, being connected to it by a plurality of ribs 14. A weld 8 can be seen in the enlarged view of FIG. 5; this weld allows the material in the region of the flat surfaces 5, 6 to run together and thus produces the piston 1 as a single unit. Arc strip grooves 9 and the sealing pin bores 18 can now be machined into the sidewalls 3, 4 in the conventional manner.

Figure 3:
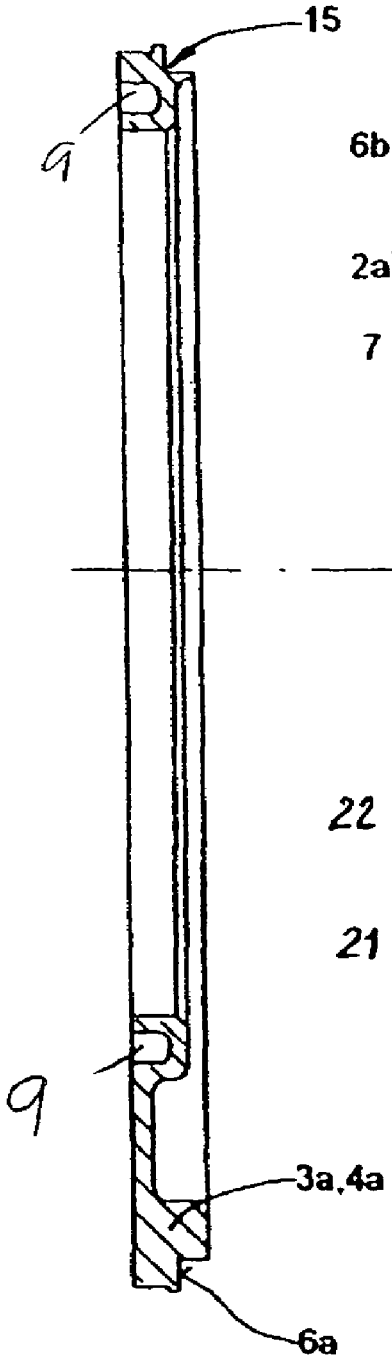
FIG. 3 shows a cross section of a sidewall with a step, this wall being identical in design to the sidewall on the power takeoff side.
Figure 4:
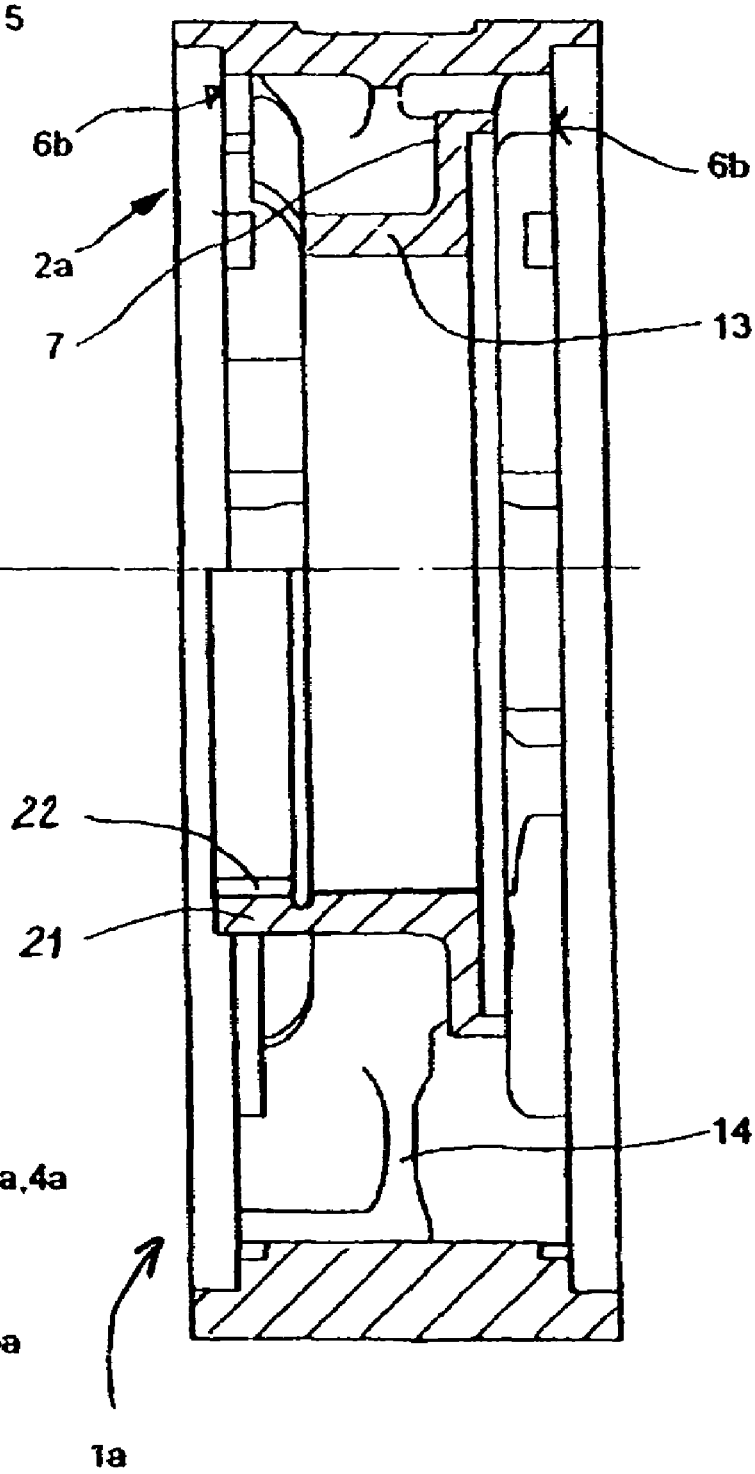
FIG. 4 shows a cross section of a piston housing with a circumferential flat surface on one side and a circumferential flat surface on the power takeoff side and with a set of internal gear teeth on the ring element.
Figure 6:
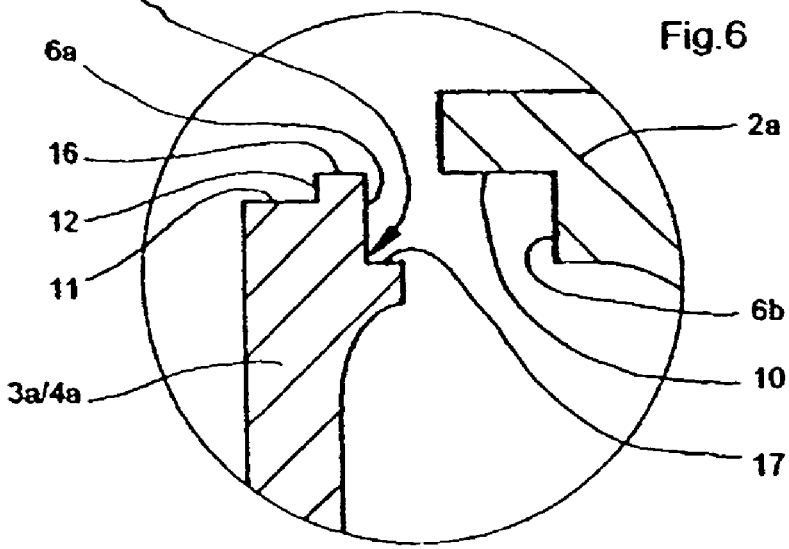
FIG. 6 shows an enlarged view of the elements according to FIGS. 3 and 4 before they are joined.
Figure 7:
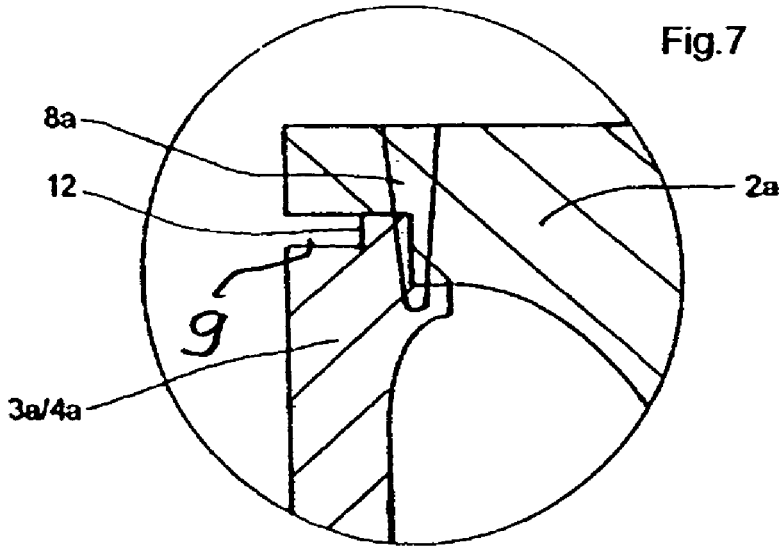
FIG. 7 shows an enlarged view of the elements according to FIG. 6 after they have been assembled and welded.

For a second embodiment of a piston l*a*, FIG. 3 shows a sidewall 3*a*, which is identical in design to a sidewall 4*a* on the power takeoff side. Each of the sidewalls 3*a*, 4*a* has a circumferential contact surface 6*a*, which can be laid against a circumferential contact surface 6*b* of the piston housing 2*a*, as can be seen in FIG. 4. Here, a ring-shaped shoulder 21 with the outside dimensions of an internal gear 22 is formed integrally on the ring element 13. It is obvious from a simultaneous consideration of the enlarged views of FIGS. 6 and 7 that the sidewall 3*a*, 4*a* is bounded externally by a first contour 16, which coincides with an outer flank 10 of the arc strip groove 9 in the piston housing 2*a*. The previously mentioned circumferential contact surface 6*a* is bounded by a second contour 17, so that a right-angled step 15 is formed, which is equidistant from the first contour 16. The sidewall 3*a* can now be installed in the previously described position on the piston housing 2*a*.

For the sake of efficiency, an inner flank 11 equidistant from the first contour 16 is also provided. When the sidewall 3*a*, 4*a* is put into position, this inner flank and the groove base 12 perpendicular to it cooperate to form the exact profile required for the arc strip grooves 9. There is no need for any finishing work on the arc strip grooves 9, because, as in the case of first embodiment of the piston 1, the weld 8*a* is produced radially from the outside. This time, however, it must pass first through solid material, then along the circumferential contact surfaces 6*a*, 6*b*, and finally back into the solid material of the sidewall 3*a*, 4*a* again, where the weld 8*a* runs out. The arc strip grooves 9 are completed by drilling out the sealing pin bores 18.

Figure 8:
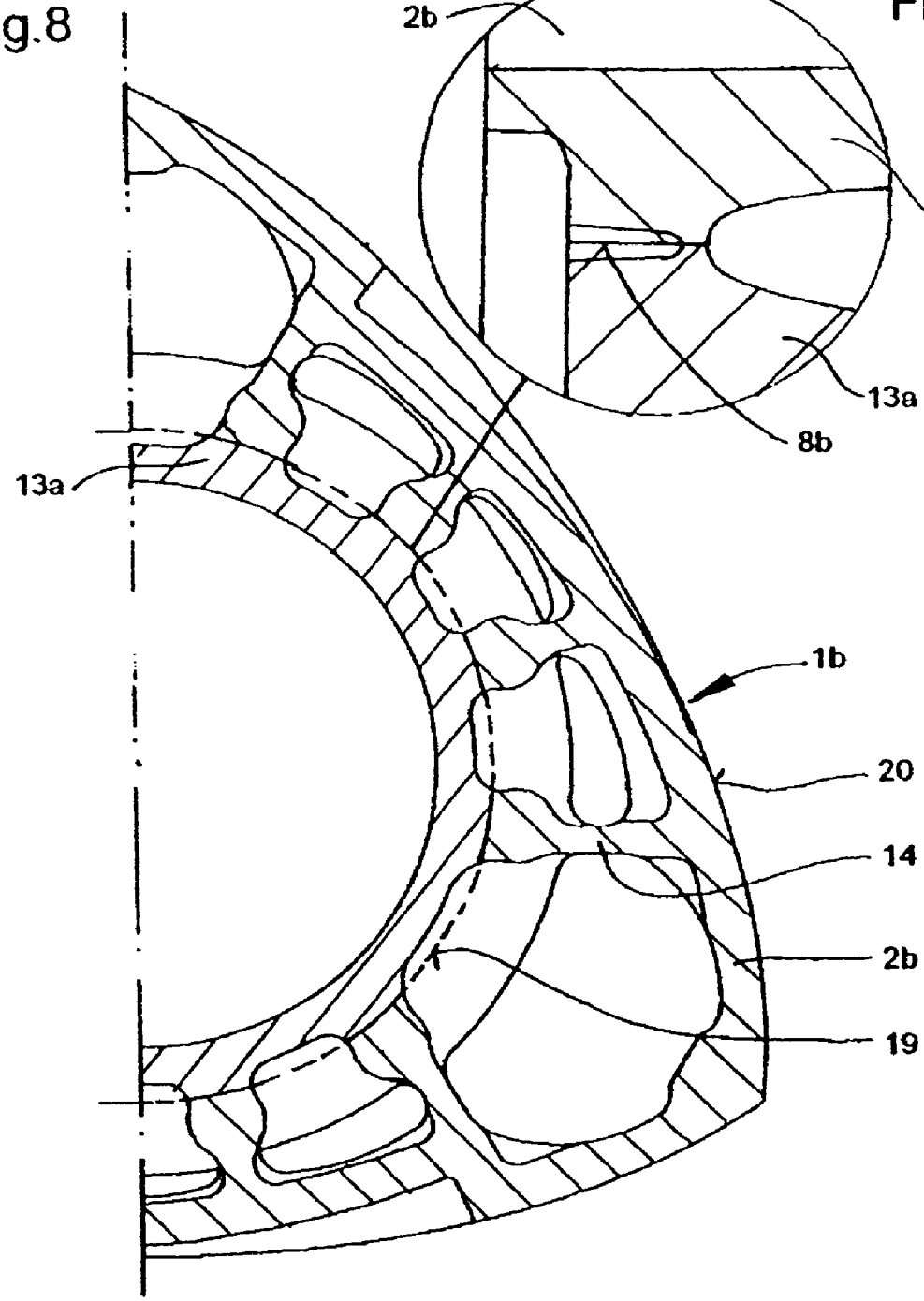
FIG. 8 shows a piston with a ring element, which is connected to the piston housing by a plurality of ribs.
Figure 9:
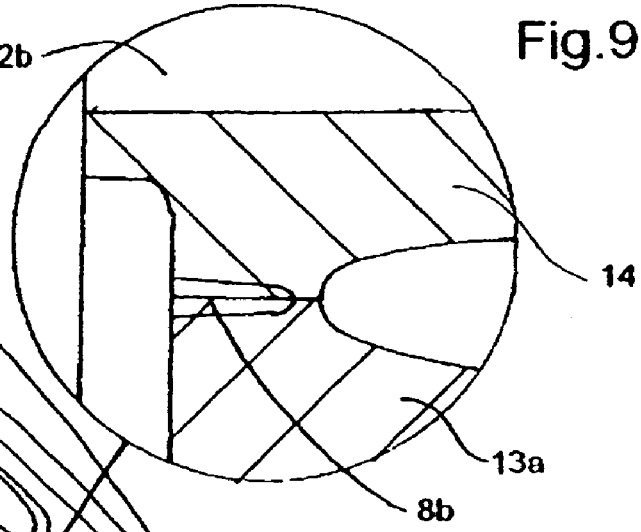
FIG. 9 shows an enlarged view of a weld between the ring element and a rib.

A third embodiment of a piston 1*b* can be seen in the enlarged views of FIGS. 8 and 9. This piston has a housing 2*b*, which is similar to a conventional piston except for a ring element 13*a*, which must be welded into the piston housing 2*b*. In this embodiment, the interior of the piston housing 2*b* with its oil-conducting profiles is no longer open on both sides; instead, it is open radially toward the inside, which makes the work of the model builder easier to the extent that a circumferential core can be used for casting, which costs less to produce than the cores used for the production of the conventional piston, the number of which must be the same as the number of ribs 14. A weld 8*b* connects each rib 14 to the ring element 13*a* in the region of an encircling cylindrical plane 19.

In comparison with first embodiment, second embodiment offers the advantages of optimal welds 8*a*, of a simple method for connecting the sidewalls 3*a*, 4*a*, and of the elimination of the need for machining the arc strip grooves 9. Second embodiment also has advantages over third embodiment, because the quality of the welds 8*b* may not always meet the requirements.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A triangular piston configured to receive an eccentric shaft of a rotary combustion engine, the triangular piston comprising:

a housing comprising:

a pair of axially spaced flanks, and a triangular outer periphery bridging the pair of flanks;

respective sidewalls welded to the flanks of the housing so as to form a respective welded region between each of the sidewalls and the housing, each of the welded regions having respective axially extending pin bores, and the sidewalls each being configured with a thickness greater than a depth of the pin bore; and fluid-conducting ribs formed within the housing between the sidewalls.

2. The piston of claim 1, wherein the welded regions each extend from the outer periphery of the housing through the flank into the sidewall in a plane parallel to the flank.

3. The piston of claim 1, wherein each of the flanks comprises a recessed circumferential contact surface and each of the sidewalls comprises a recessed outer peripheral contact surface, the contact surfaces of the affixed sidewall and flank being configured so as to define a respective arc strip groove.

4. The piston of claim 3, wherein the outer peripheral contact surface of the sidewalls has a radial protrusion extending radially outwardly towards a respective one of the pair of flanks so as to define therebetween the respective arc strip groove upon affixing the sidewalls to the respective flanks of the housing.

5. The piston of claim 4, wherein each of the sidewalls has an inner surface provided with an axially inwardly extending protrusion spaced radially inwardly from the radial protrusion of the sidewall and passing circumferentially around the housing.

6. The piston of claim 1, wherein the welded regions each axially extend along a contact surface of the welded sidewall and flank.

7. The piston of claim 1, wherein the welded regions each extend through the housing and terminate in the respective sidewall.

8. A rotary piston engine comprising the triangular piston of claim 1.

9. A triangular piston configured to receive an eccentric shaft of a rotary combustion engine, the triangular piston comprising:

a housing comprising:

a pair of axially spaced flanks, and a triangular outer periphery bridging the pair of flanks;

respective sidewalls welded to the flanks of the housing so as to form a respective welded region between each of the sidewalls and the housing, each of the welded regions extending from the outer periphery of the housing through the flank into the sidewall in a plane parallel to the flank; and fluid-conducting ribs formed within the housing between the sidewalls.

10. A triangular piston configured to receive an eccentric shaft of a rotary combustion engine, the triangular piston comprising:

a housing comprising:

a pair of axially spaced flanks, and a triangular outer periphery bridging the pair of flanks;

respective sidewalls welded to the flanks of the housing so as to form a respective welded region between each of the sidewalls and the housing, each of the welded regions extend through the housing and terminate in the respective sidewall; and fluid-conducting ribs formed within the housing between the sidewalls.

11. A triangular piston configured to receive an eccentric shaft of a rotary combustion engine, the triangular piston comprising:

a housing comprising:

a pair of axially spaced flanks, and a triangular outer periphery bridging the pair of flanks;

respective sidewalls affixed to the flanks of the housing; and fluid-conducting ribs formed within the housing between the sidewalls;

wherein each of the flanks comprises a recessed circumferential contact surface and each of the sidewalls comprises a recessed outer peripheral contact surface, the contact surfaces of the affixed sidewall and flank being configured so as to define a respective arc strip groove; and wherein the outer peripheral contact surface of the sidewalls has a radial protrusion extending radially outwardly towards a respective one of the pair of flanks so as to define therebetween the respective arc strip groove upon affixing the sidewalls to the respective flanks of the housing.

* * * * *